United States Patent [19]

Keren et al.

[11] 4,074,505

[45] Feb. 21, 1978

[54] METHOD AND APPARATUS FOR PACKAGING ARTICLES

[75] Inventors: Eitan Keren, Wayne; Harold J. Brown, Lyndhurst, both of N.J.

[73] Assignee: Sealed Air Corporation, Fair Lawn, N.J.

[21] Appl. No.: 756,254

[22] Filed: Jan. 3, 1977

[51] Int. Cl.[2] ..... B65B 9/02

[52] U.S. Cl. ..... 53/28; 53/182 R

[58] Field of Search ..... 53/28, 180 R, 180 M, 53/182 R, 182 M

[56] References Cited

U.S. PATENT DOCUMENTS

| | | | |
|---|---|---|---|
| 2,657,510 | 11/1953 | Lewis | 53/180 M X |
| 3,405,502 | 10/1968 | Badder | 53/180 X |
| 3,552,088 | 6/1971 | Niwa | 53/182 R X |
| 3,991,540 | 11/1976 | Ballestrazzi et al. | 53/182 R X |

*Primary Examiner*—Travis S. McGehee

*Attorney, Agent, or Firm*—Eugene E. Geoffrey, Jr.

[57] ABSTRACT

Apparatus for packaging articles by enclosing an article between two layers of sheet materials, each having cohesive coatings thereon which includes two spaced sets of relatively small independently mounted rollers for feeding the sheet materials and cutting and sealing heads disposed in close proximity to said sets of rollers and means for controlling the sheet feeding rate and the cutting and sealing operation to produce packages of any desired length.

12 Claims, 15 Drawing Figures

Fig. 8.
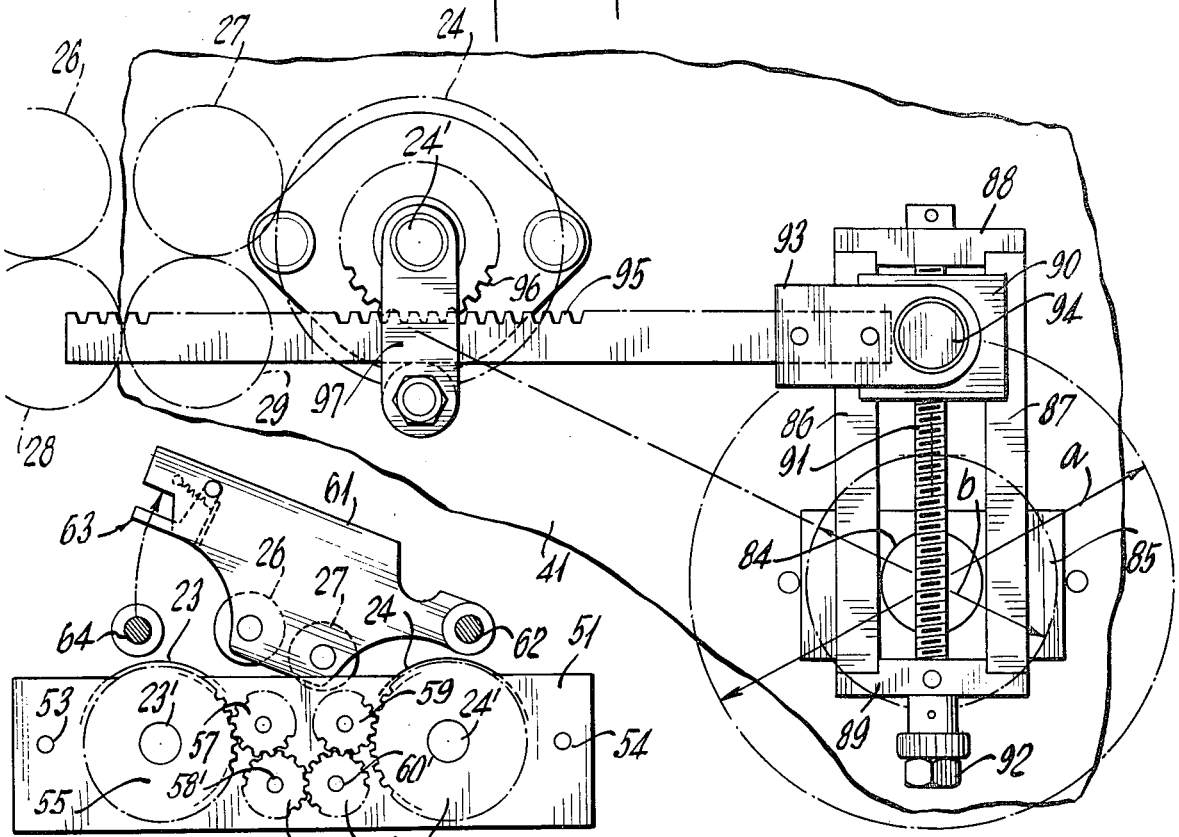
Fig. 7a.
Fig. 9.
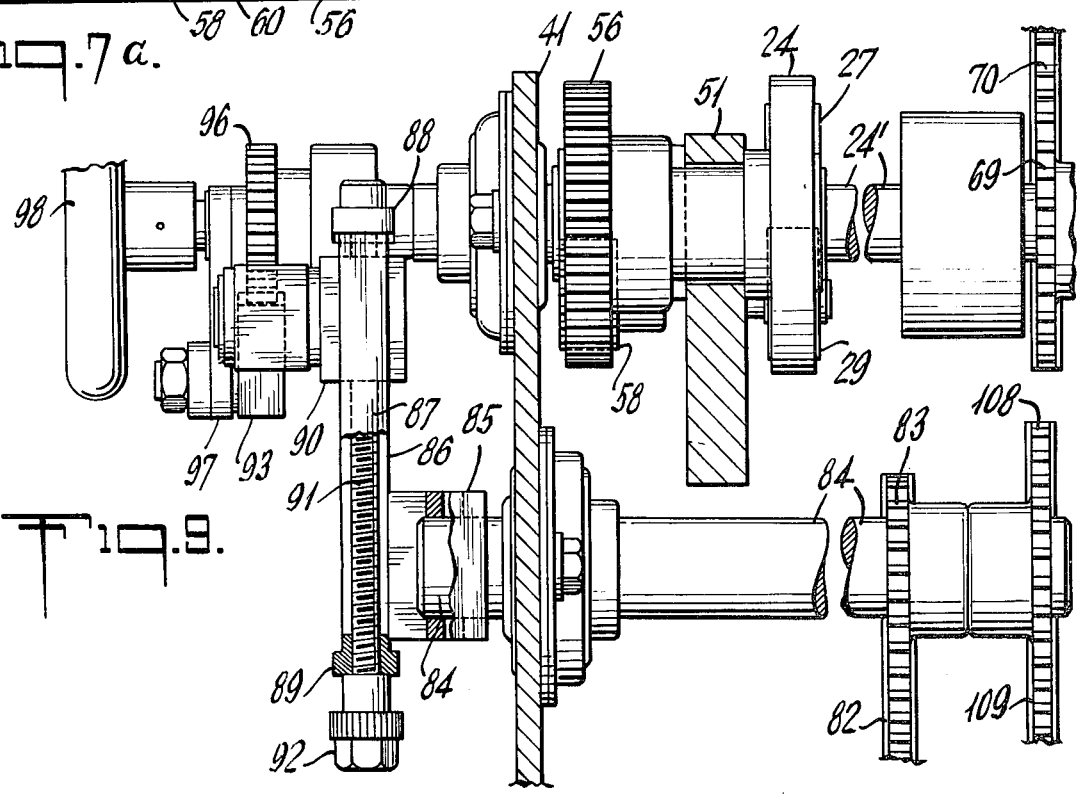

Fig.12.
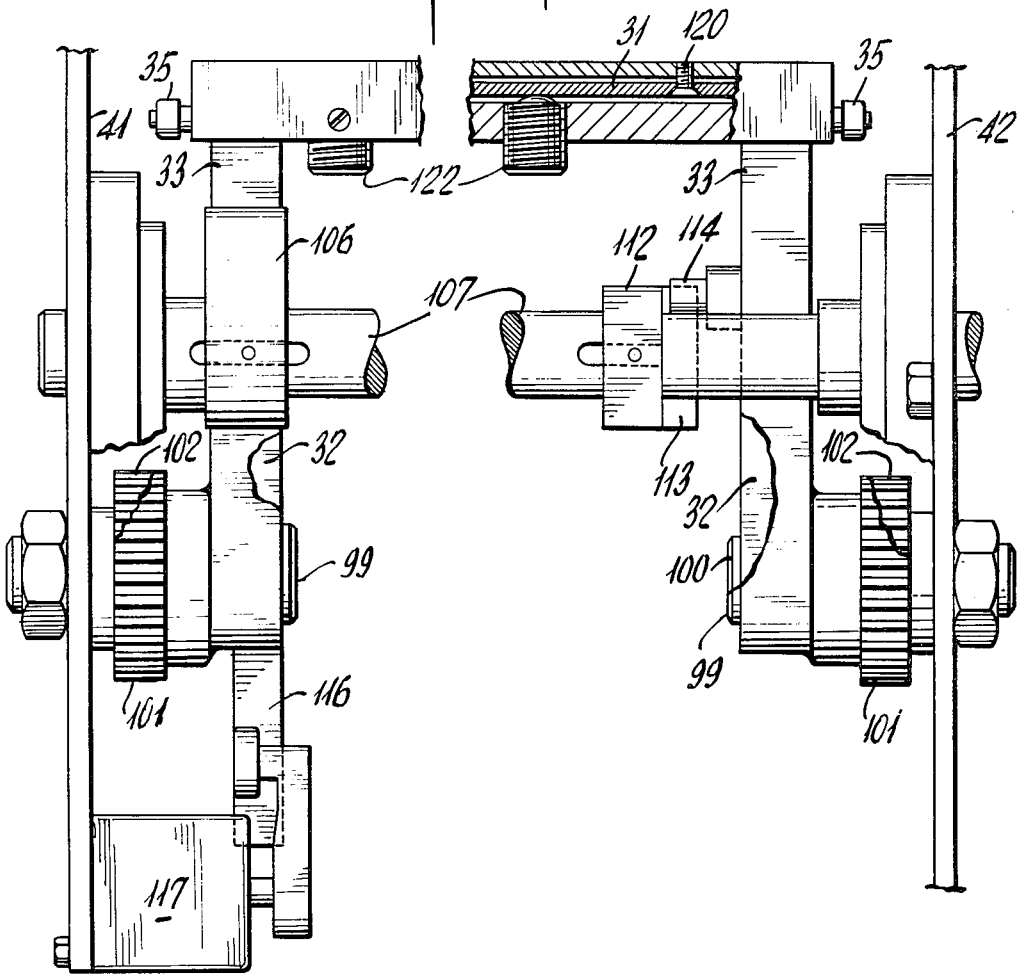
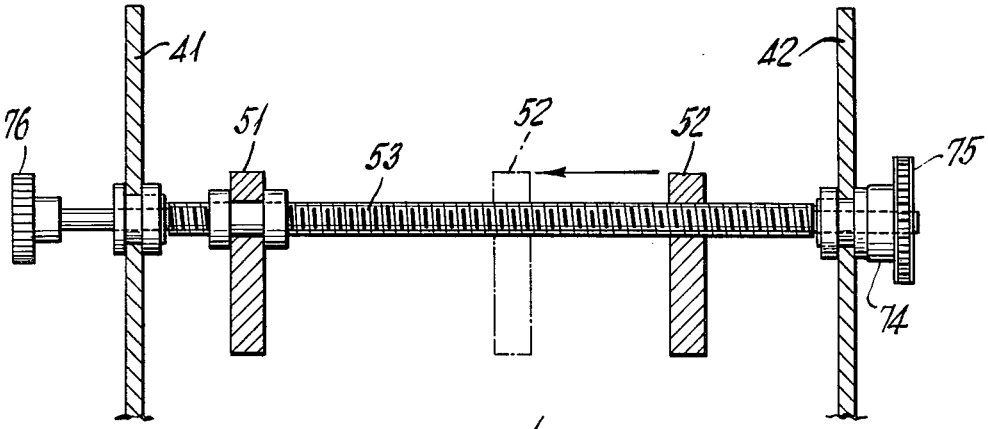
Fig.14.

METHOD AND APPARATUS FOR PACKAGING ARTICLES

This invention relates to the automatic packaging of articles and more specifically to a novel and improved method and apparatus for packaging articles utilizing sheet materials having cohesive coatings on one side thereof so that when the edges of two sheets with an article or articles therebetween are brought into contact, the coatings will cohere to form a closed contained with said articles disposed therein.

Prior packaging apparatus utilized two sets of spaced rollers with the coated sheet materials being fed about at least a portion of the peripheries of said rollers and between the nips in order to seal the side edges of the cohesive materials. Cutting means were disposed beneath the rollers in order to sever the cohered sheets, complete the top of one package and seal the bottom edge of the next package. The articles to be packaged were inserted between the sheet materials as they passed over the rollers and were retained by the sheets since the bottom had been sealed in the course of the cutting operation and accordingly would be retained therebetween. Upon insertion of the articles, the rollers were operated to feed the resultant bag with the articles therein downwardly beyond the cutting means whereupon it would be severed and the apparatus prepared for receiving the next article or articles to be packaged. Inasmuch as the sheet material of necessity had to pass between the nips of the two sets of rollers in order to seal the side edges, the cutting means necessarily had to be spaced below the rollers. To package large items, large diameter rollers were required to provide distance between the roller shafts. Since the cutting means must be positioned beneath the rollers, this resulted in substantial material waste. To modify the length of a bag, the cutting means was shifted vertically so that each bag would be severed above the article being packaged. Thus for a given length of bag, the cutting means had to be spaced from the axes of the roller shafts a distance equal to the length of the bag. Thus with prior devices the length of the bag was limited to the maximum travel of the cutting means. If, on the other hand, the cutting means was positioned close to the rollers, the resulting bag would be larger than required and the distance between the roller shafts and the cutting means would be a measure of the wasted material.

This apparatus provides a novel and improved packaging device utilizing the sheets coated with a cohesive material wherein articles of a great variety of sizes can be packaged and wherein the length of a bag can be controlled so that when packaging small articles, the length can be reduced to prevent unnecessary waste of material. Furthermore, the size of the article is not controlled by the diameter of the sealing rollers so that articles of any thickness can be packaged provided, however, that the coated material is of a sufficient width. Furthermore, with the instant invention, the apparatus can be readily adjusted to accommodate different widths of materials so that when packaging smaller articles, the sealing rollers can be brought closer together to accommodate material of decreased width and at the same time, the bags can be made of any length in the event long, narrow articles are to be packaged.

Another advantage of the invention resides in the utilization of means for effectively gripping the edges of the two sheets of material as they are sealed together and thus prevent them from slipping off of the rollers during the packaging operation. When packaging relatively thick articles, it is of course necessary to cause the sheets to spread and in so doing there is a tendency for the edges of the sheets to become disengaged from the sealing rollers. With the instant invention, however, the sheets are firmly gripped by the sealing rollers with the result that the possibility of disengagement of the sheets from the rollers is minimized if not effectively prevented. Furthermore, should the material slip from the sealing rollers, the material will be automatically guided back into position since it is still clamped by the feed rollers.

Still another object of the invention resides in the provision of novel and improved packaging apparatus for sealing articles between two sheets of material each having a cohesive coating thereon and wherein articles of a wide variety of shapes and sizes can be readily packaged.

The invention provides for the utilization of sets of relatively small rollers on each side of the apparatus with means for adjusting the spacing between the rollers in order to accommodate sheets of packaging material of different widths. The utilization of the sets of rollers on each side of the apparatus which are individually pivoted but driven in synchronism, common shafts are omitted with the result that a wide range of sizes of articles can be packaged. Furthermore, inasmuch as the sets of rollers are relatively small in diameter, the cutting means disposed beneath the rollers can be positioned in close proximity to the rollers and thus enable the formation of short bags or containers for small articles, with minimum waste of material.

The above and other objects and advantages of the invention will become more apparent from the following description and accompanying drawings forming part of this application.

FIG. 7*a* is a side elevational view of the driving gears for the feed rollers with two rollers in a raised position to facilitate threading of the sheets.

Figure 7:
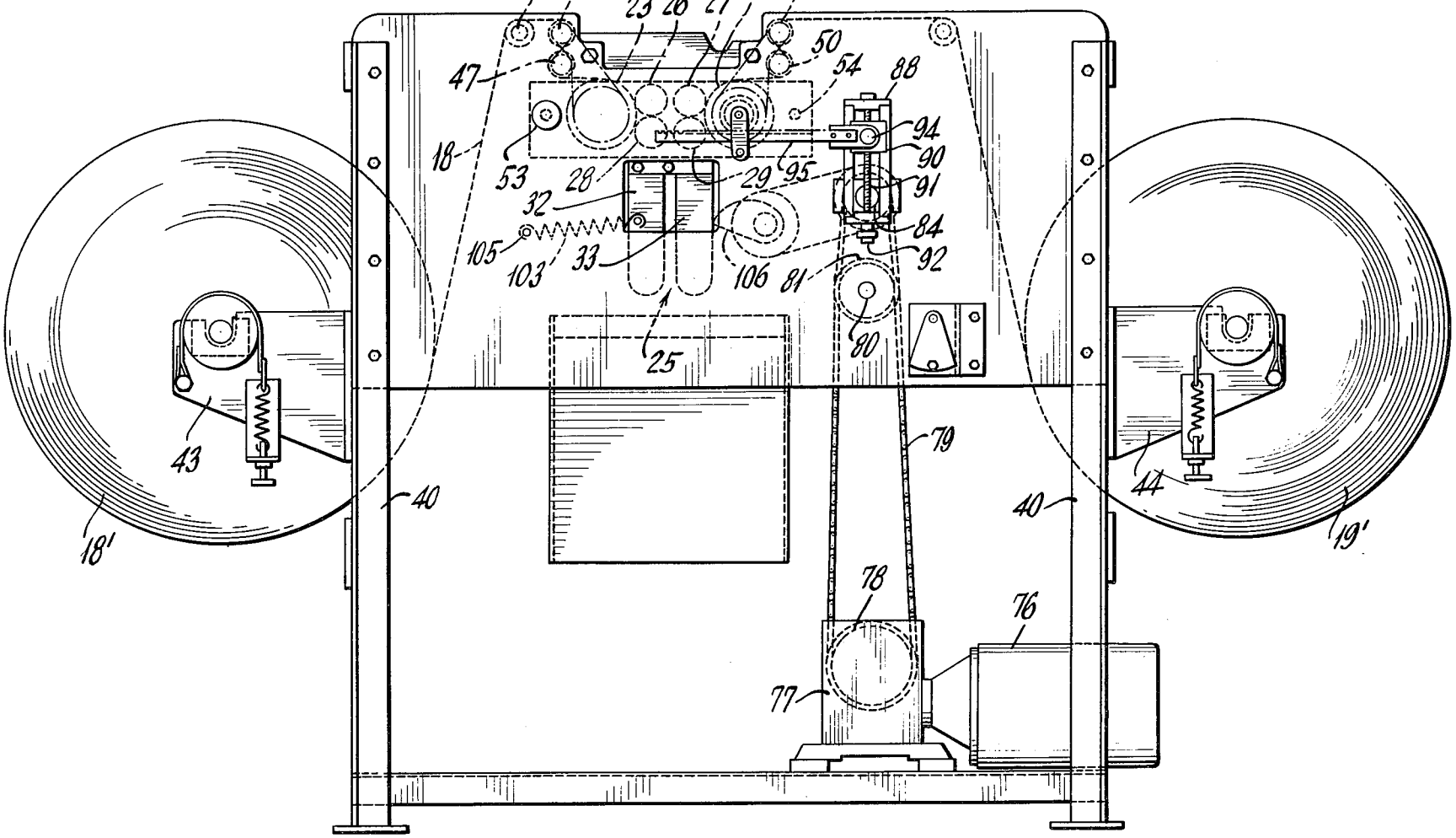
FIG. 7 is a side elevational view of the packaging apparatus in accordance with the invention.

FIG. 8 is an enlarged fragmentary side elevational view of a portion of FIG. 7 illustrating the apparatus for controlling the magnitude of the feed to produce bags of selected lengths.

FIG. 9 is a side elevational view of the apparatus illustrated in FIG. 8.

Figures 10, 11, 12:
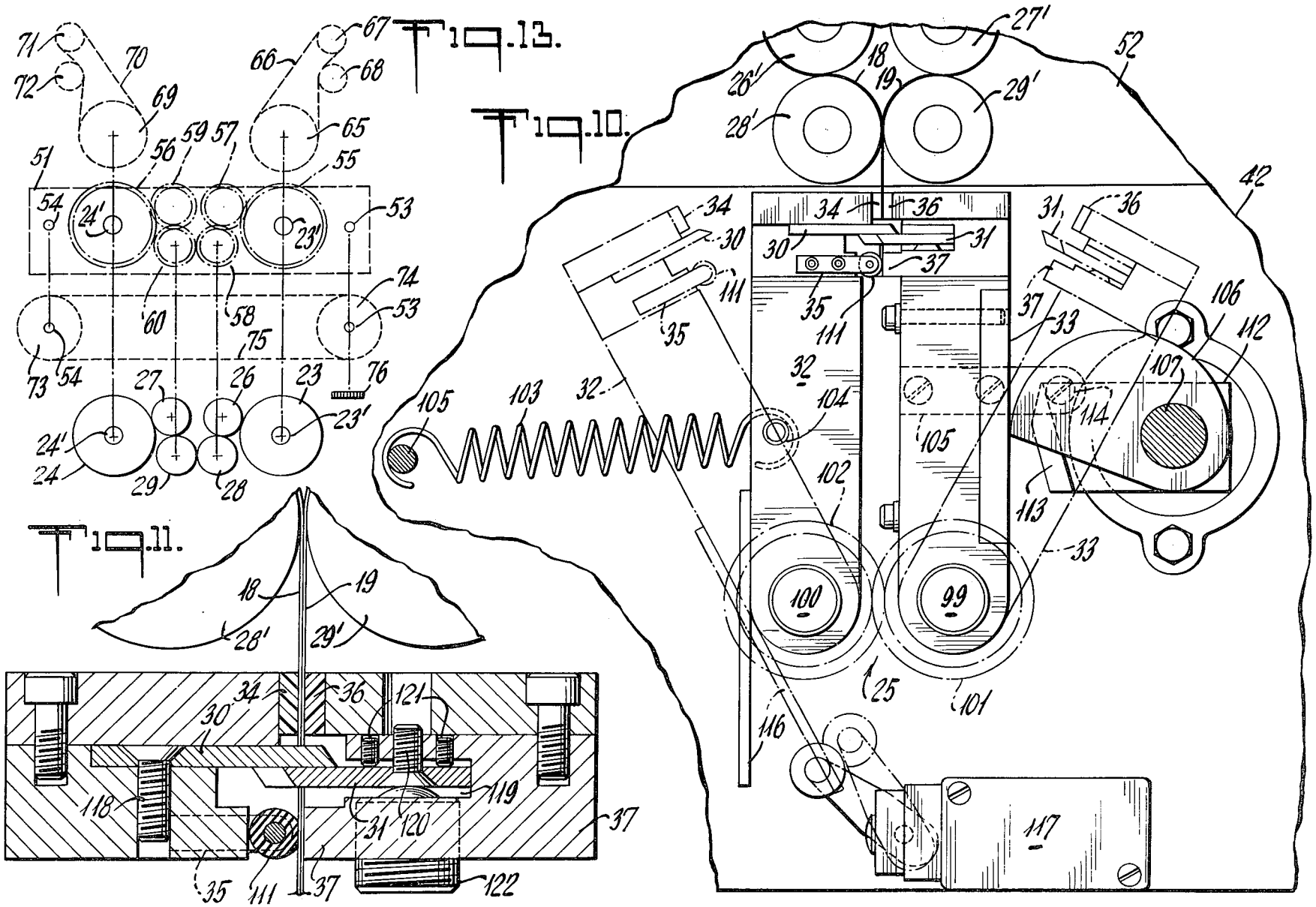

FIG. 10 is a side elevational view in partial section of a cutting mechanism disclosed below the feed rollers.

FIG. 11 is an enlarged cross-sectional view of a fragmentary portion of the cutting mechanism.

FIG. 12 is a side view in partial section of the cutting mechanism as viewed in FIG. 10.

FIG. 13 is a diagrammatic view showing the driving means for both the drive rollers and for adjusting the space between the sets of rollers to accommodate different widths of packaging material, and FIG. 14 is a side elevational view of the means for adjusting the spacing between the feed rollers.

Figure 1:
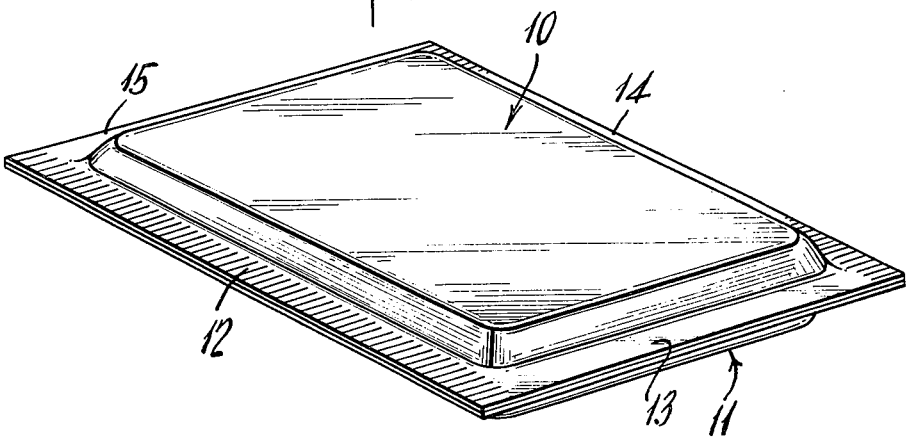
FIG. 1 is a perspective view of a packaged produced by apparatus in accordance with the invention.

As pointed out above, this invention concerns a novel and improved method and apparatus for packaging articles through the utilization of two sheets of material each having a layer of a cohesive material on one surface thereof and a typical package produced by such apparatus is illustrated in FIG. 1. It will be observed that the package includes an upper layer 10 of sheet material and a lower layer of sheet material 11. The layers have on the inner surfaces thereof a coating of cohesive material and the apparatus functions to seal the edge portions 12, 13, 14 and 15. As will become apparent from the description, the sheets are fed by knurled rollers which leave impressions on the edges 12 and 14 as viewed in this figure while the edges 13 and 15 are formed by the cutting mechanism as will be described and severs a completed bag and provides a transverse seal for the formation of the next successive bag.

Figure 2:
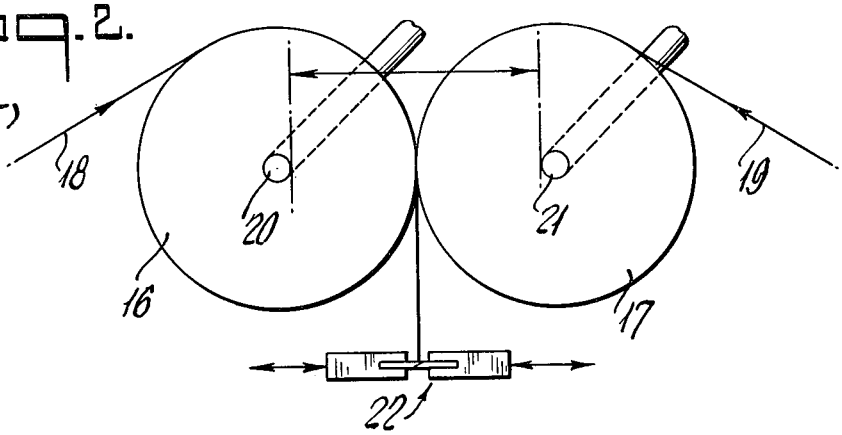
Fig. 2. (PRIOR ART)
FIG. 2 is a side elevational view of a prior art device for packaging articles.

Prior packaging devices have had serious limitations both in the thickness of an article that can be packaged as well as in the length of the bag that can be formed. This is illustrated generally in FIG. 2 which shows a pair of rollers 16 and 17 about which sheet packaging materials 18 and 19 are fed. The materials 18 and 19 pass through the nip of the rollers and are thus sealed together at the edges. A second pair of rollers 16 and 17 would be positioned to engage the opposing edges of the sheet materials 18 and 19. Since each of the rollers 16 and 17 and their cooperating rollers would be mounted on single shafts 20 and 21, the thickness of an article would be limited by the distance between the shafts 21 and 21. In order to have this diatance a reasonable value to accommodate a variety of articles, it is necessary to have large diameter rollers 16 and 17 in order to accommodate relatively thick articles. This large diameter dictates that the knife 22 must be moved up and down to cut at the second pouch to avoid a substantial waste of material. This difficulty is overcome with the instant invention as illustrated diagrammatically in FIG. 3.

Figure 3:
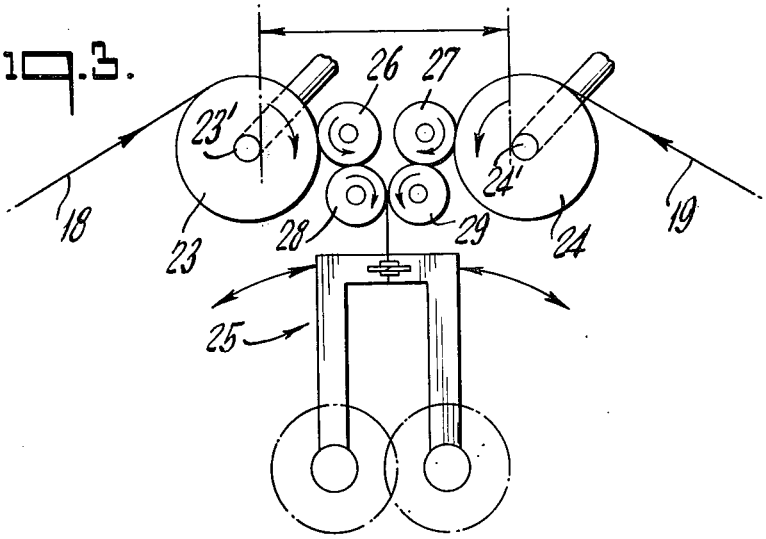
FIG. 3 is a side elevational view in diagrammatic form illustrating a structure in accordance with the invention.

In FIG. 3, which for convenience illustrates the rollers on only one side of the apparatus, the sheets of material 18 and 19 are fed about sets of spaced rollers 23 and 24 having resilient coatings. The corresponding rollers 23*a* and 24*a* on the other side of the apparatus will be described. The distance between the roller shafts 23' and 24' is relatively wide and any desired spacing can be obtained without interferring with the cutting mechanism generally denoted by the numeral 25 and disposed beneath the rollers 23 and 24. Between the rollers 23 and 24 there are disposed a pair of knurled rollers 26 and 27 and a pair of smooth rollers 28 and 29 having resilient coatings. As will be shown, the rollers 23, 24 and 28, 29 are individually supported and driven by appropriate gearing means to feed the sheets 18 and 19. The knurled rollers 26 and 27 are held in pressure engagement with their associated rollers as for instance the roller 26 is held in pressure engagement with the rollers 23 and 28 while the knurled roller 27 is held in pressure engagement with the rollers 24 and 29. Inasmuch as the rollers 26 through 29 are mounted on individual shafts as will be described and their shafts do not extend transversely of the apparatus, exceedingly thick articles can be packaged, and at the same time, since the rollers 28 and 29 are relatively small in diameter, the cutting means 25 can be positioned in close proximity to these rollers thereby minimizing material waste. Furthermore, by operating the cutting means at predetermined intervals and varying the rate at which the material is fed over the rollers 23, 24 and 28, 29 any length bag can be produced. The important advantage of the invention is that extremely short bags can be produced with this apparatus while at the same time enabling articles of substantial thickness to be packaged.

Figure 4:
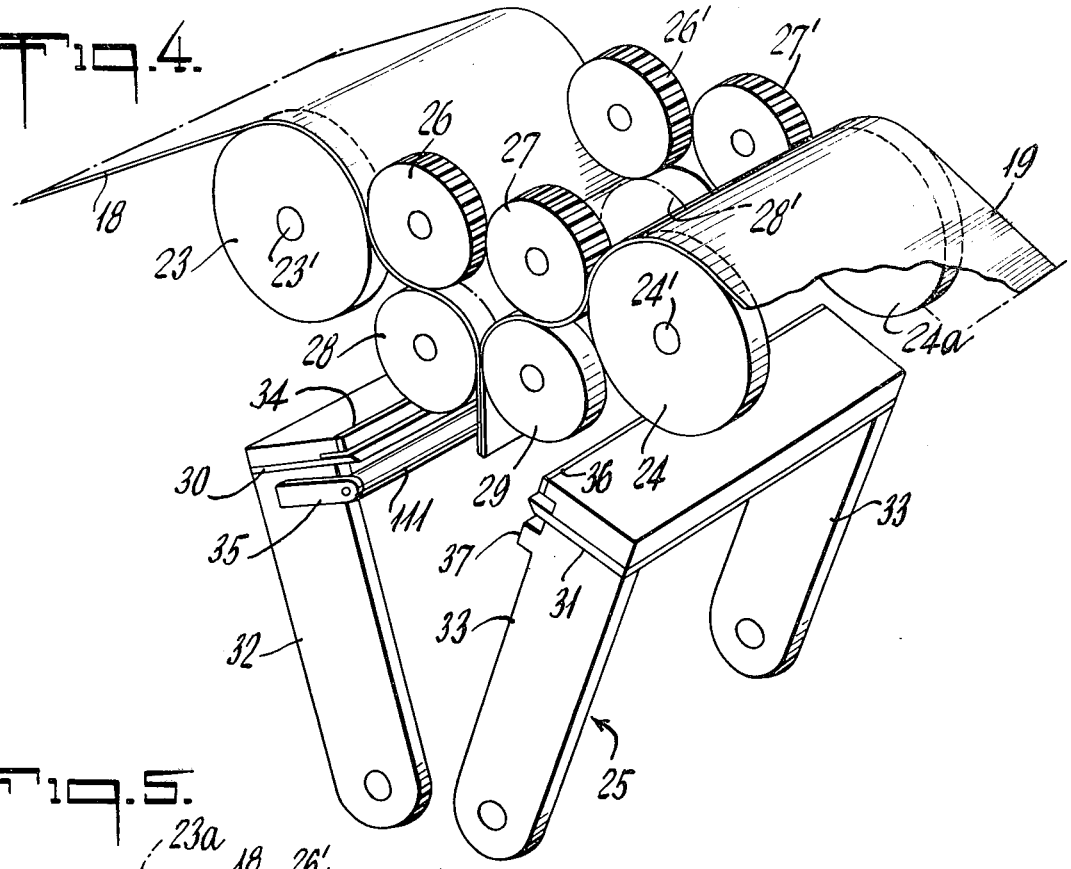
FIG. 4 is a perspective view in diagrammatic form showing the paths of the sheets of material about the rollers to form a bag for the reception of articles to be packaged and the cutting means for severing and sealing each bag after the articles have been placed therein, and sealing the downwardly extending portions of the sheets in preparation for the formation of the next bag.
Figure 5:
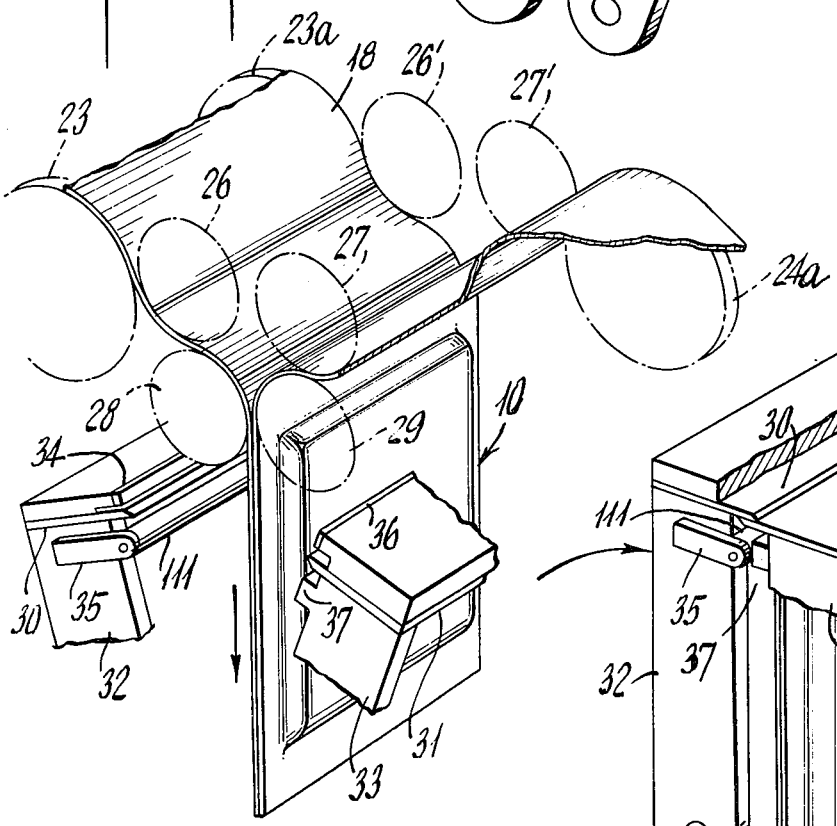
FIG. 5 illustrates the position of a filled bag just prior to severence.
Figure 6:
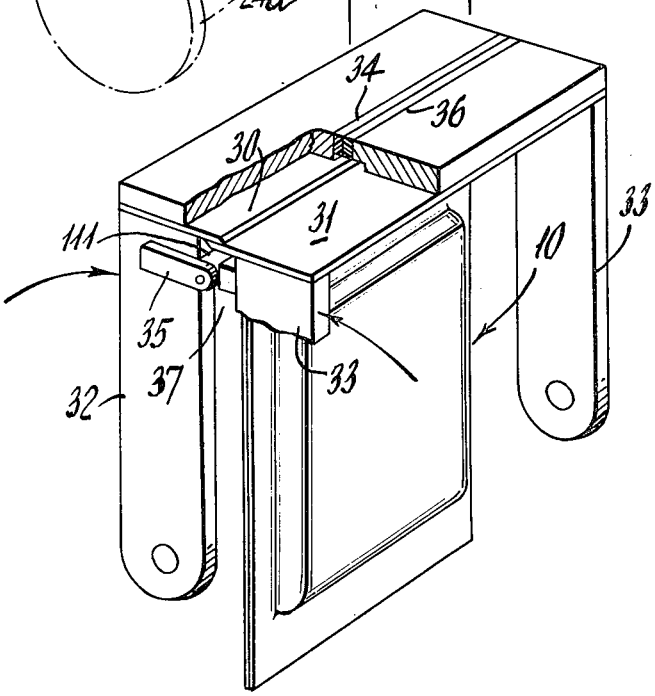
FIG. 6 illustrates the severing of the filled bag to complete the packaging operation.

FIGS. 4 through 6 illustrate diagrammatically the operations involved in the packaging of an article with apparatus in accordance with the invention. More specifically, rollers 23 and 24 each comprise two spaced discs 23 and 23*a*, and 24 and 24*a* with the discs 23 and 23*a* being carried by the shaft 23'. Thus the maximum width of an article that can be packaged is determined by the distance between the shafts 23' and 24'. The rollers 26 through 29 and 26' through 29' are each independently supported and driven in synchronism with their respective rollers 23, 23*a* and 24 and 24*a*. The sheets of material 18 and 19 are fed over rollers 23, 23*a* and 24, 24*a* and beneath the knurled rollers 26, 27 and 26' and 27', thence about the rollers 28 and 29 and 28' and 29', the latter being in pressure engagement to form a side seal between the two sheets of material. The cutting assembly 25 comprises two cutting heads 30 and 31, each carried by downwardly extending arms 32 and 33 which are pivoted to the apparatus. The heads 30 and 31 also include butting means 34 and 35 and 36 and 37 disposed above and below the blades 30 and 31 so that when the cutting operation is effected, the bag to be severed is sealed along the top edge while the transverse edges of the sheets 18 and 19 disposed above the cutting blade are also sealed in preparation for the formation of the next successive bag. After a bag has been severed, the next article to be packaged is then inserted between the sheets 18 and 19 whereupon the machine is actuated to feed the material downwardly between the rollers 28, 29 and 28' and 29' as shown in FIG. 5. The cutting means 25 is then actuated to seal the top of the bag, sever the completed bag, and seal the downwardly extending edges of the two sheets 18 and 19. FIG. 6 shows the operation of the cutting means which automatically performs the three functions mentioned above.

The apparatus for performing the steps of packaging articles as discussed above is illustrated in FIGS. 7 through 14. Referring to FIG. 7 showing a side elevation of the apparatus in accordance with the invention, the numerals 40 denote a pair of vertical supports for holding a side frame portion 41 and a similar pair of vertical supports are disposed behind the supports 40 and hold a second frame member 42 similar to the frame member 41 and illustrated more clearly in FIG. 12. The cohesive coated sheet 18 is fed from a roll 18' carried by a bracket 43 secured to the posts 40 on one end of the apparatus while the sheet 19 is fed from a roll 19' carried by a bracket 44 supported by posts 40 on the other end of the apparatus. The sheet 18 passes from the roll 18' about a transverse shaft 45 and then about driven shafts or rollers 46 and 47 rotatably supported between frame elements 41 and 42. Similarly, the sheet 19 passes about a shaft 48 and thence about driven shafts or rollers 49 and 50 rotatably carried by the frame portions 41 and 42.

The rollers 23, 25, 28 and 29 are carried on the inside of a plate 51 which is supported by the frame portion 41 and a similar plate 52 as shown in FIG. 14 carries the rollers 23*a*, 24*a*, 28' and 29'. The plates 51 and 52 are supported by threaded rods 53 and 54 (see FIG. 14) extending between and rotatably carried by the frame portions 41 and 42 with the plate 51 being fixed in position while the plate 52 threadably engages the rods. Since the rods are mechanically coupled, as one of the rods is rotated, as for instance the rod 53, both rods 53 and 54 will rotate to change the spacing between the plates 51 and 52. This is for the purpose of accommodating sheet materials of different widths.

Since the structures of both plates 51 and 52 are substantially identical, only the structure of plate 51 will be described.

As pointed out above, the rollers 23, 24, 28 and 29 are carried by the plate 51 with the roller 23 being keyed to the transverse shaft 23' extending between the frame portions 41 and 42 while the roller 24 is keyed to a similar shaft 24'. The shafts 23' and 24' extend through the plate 51 and carry gears 55 and 56 as shown more clearly in FIG. 7*a*. The gear 55 meshes with gear 57 rotatably carried on the plate 51 and it in turn meshes with a gear 58 also carried by the plate 51. The shaft 58' carrying the gear 58 extends through the plate 51 and carries the roller 28. Similarly, the gear 56 meshes with the gear 59 rotatably carried by the plate 51, and it in turn meshes with gear 60 which is mounted on the shaft 60'. This shaft carries the roller 29. Since gears 58 and 60 also mesh one with the other, all rollers are driven in synchronism.

The rollers 26 and 27, each having a knurled periphery, are carried by a plate 61 which is pivoted to a transverse rod 62 extending between the frame elements 41 and 42 so that it may be moved upwardly as illustrated in FIG. 7*a*. Other suitable means may also be employed for support and movement of the plate. The left side of the plate 61 as illustrated in FIG. 7*a* is provided with latching means 63 to facilitate engagement with a transverse rod 64 also extending between the frame elements 41 and 42. These knurled rollers 26 and 27 bear against the rollers 23 and 24 and 28 and 29 to firmly hold the webs or sheets 18 and 19 therebetween. The knurled rollers 26' and 27' are also carried by a pivoted plate in the same manner as the rollers 26 and 27.

Referring to FIG. 13, it will be observed that the gear 56 drives the gears 59 and 60. The gear 60 effects rotation of the roller 29 and at the same time drives the gear 58 which rotates the roller 28. The gear 58 drives the gear 55 through the gear 57. The shaft 23' carrying the gear 55 also carries a sprocket 65 which through a chain 66 drives sprockets 66 and 68 which are affixed to the shafts 46 and 47 for feeding the sheet material 18'. Similarly the shaft 24' carries a sprocket 69 which drives a chain 70 engaging sprockets 71 and 72 carried by the shafts 49 and 50 for driving the web 19. The shafts 53 and 54 which threadably carry the plates 51 and 52 as previously described are also provided with sprockets 73 and 74 coupled by a chain 75. A hand wheel 76 is coupled to the shaft 54 so that rotation of the shaft 54 will also rotate the shaft 53 and thereby change the position of the plate 52.

The principal drive comprises a motor 76 driving a gear box 77 having a driven sprocket 78. This sprocket is coupled by a chain 79 to a sprocket 80 which is coupled through a clutch to a second sprocket 81. The sprocket 81 is coupled by a chain 82 to a sprocket 83 carried by shaft 84. The outer end of the shaft 84 carries a plate 85 which in turn has elongated guides 86 and 87 secured thereto. These guides are held in spaced relationship by transverse members 88 and 89. A slide 90 carried by the guides 86 and 87 and is positioned relative thereto by a threaded adjusting screw 91 which can be rotated by a hexagonal head 92 to change the position of the slide 90 relative to the axis of the shaft 84. The carriage 90 has a member 93 pivoted thereto by means of a shaft 94 and the member 93 has a rack 95 extending therefrom. This rack engages a pinion, which includes an overrunning clutch, carried by the shaft 24' and held in engagement therewith by a link 97. By reason of the clutch, the pinion will rotate shaft 24' only when driven in a counter clockwise direction as shown in FIG. 8. In this way, as the shaft 84 is rotated, the pivot shaft 94 will be moved through a predetermined arc and therefore the degree of rotation of the pinion 96 will be determined by the radius of the arc. As the radius of the arc is made smaller, the travel of the gear 96 is reduced. In this way, the length of the bag which is determined by the degree of rotation of the gear 96 can be readily adjusted by rotating the lead screw 91 to position the pivot shaft 94 toward or away the axis of the shaft 84. A hand wheel 98 is provided on the shaft 24' for manual rotation if desired.

The cutting mechanism 25 functions to seal a loaded bag, sever it from the sheets of material 18 and 19 and also seal depending ends of the sheets as they emerge from beneath the rollers 28, 29 and 28' and 29' in preparation for the formation of the next bag. The portion of the cutting assembly 25 which includes arms 32—32 is carried by stud shafts 99 secured to the frame portions 41 and 42 while the arms 33—33 carrying the cooperating cutting portion are carried by the shafts 100 secured to the frame portions 41 and 42. Each of the arms 32—32 and 33—33 are provided with gears 101 and 102 with each set of gears 101 and 102 meshing one with the other so that the arms will be moved simultaneously from the dotted line position shown in FIG. 10 to the solid line position. A spring 103 is connected at one end to a post 104 on the arm 32 and at the other end to a post 105 on the frame 42, holds the arms in the dotted line position as shown in FIG. 10. Movement of the arms inwardly to effect severence of a completed bag is effected by a cam 106 carried by a shaft 107 which is pivotally supported by the frame portions 41 and 42. The shaft 107 is driven by a sprocket 108 carried by the shaft 84 (see FIG. 7), a chain 109 and a second sprocket 110 secured to the shaft 107. In this way, the cam is operated at the time power is applied to the sprocket 81 which in turn drives the sprocket 83 on the shaft 84. The cam rotates in a clockwise direction as shown in FIG. 7 and functions to close the cutting assembly 25 after the completion of the travel of a loaded bag.

When the cutting means is actuated to sever a loaded bag, the cutting blades 30 and 31, which are tapered, effect a slicing or shearing action and are so arranged that the bag is only partially severed at the time the cylindrical cushioning member 111 carried by portion 35 of one cutting head engages the cooperating portion 37 on the opposing cutting head. In this way, the seal is effected on the bag to be severed before the severence is complete. The element 111 comprises essentially a transverse rod having a resilient covering thereon. The upper sealing portions 34 and 36 on the cutting heads also include layers of a resilient material in order to effect a uniform seal between the portions of the sheet material 18 and 19 in preparation for the formation of the next bag.

It will be observed specifically in FIG. 10 as well as other figures that the rollers 28, 29 and 28', 29' are in close proximity to the heads of the cutting assembly 25. Since these rollers are small in diameter and since the rate at which the material is fed is modified to adjust the length of the bag, little if any material is wasted. Adjustment of the material feed is effected by adjusting the position of the slide 90.

After the cut has been completed to sever a loaded bag, means are provided to insure movement of the cutting assembly to the dotted line position as shown in FIG. 10 and for this purpose a second camming means 112 is carried by the shaft 107. This camming means comprises essentially the block having an inclined portion 113 extending from one surface thereof which engages a pin 114 carried by a bracket 115 on the cutting arm 33. In this way, as the cam 106 reaches the position wherein the cutting means is fully closed and the cam 106 is about to release the cutting means for movement to the open position by the spring 103, the cam portion 113 engages the pin 114 and forces withdrawal of the arms 33 with the result that the arms 32 are also forced to withdraw to the dotted line position as shown in FIG. 10.

One of the arms 32 of the cutting assembly 25 carries an actuating arm 116 for controlling a switch assembly 117 in order to terminate the operation as soon as the arms are moved to the dotted line position as shown in FIG. 10.

The cutting blades 30 and 31 may be held in position by any suitable means though in the instant embodiment of the invention as illustrated in FIG. 11, the cutting blade 30 is secured by screws 118 to the upper face of the transverse portion 35 carrying the seal roller 111. The other blade is secured within a recess 119 of the structure 37 by screws 120. Set screws 121 are spaced along the length of the blade in order to effect the desired clearance between the two blades so that a proper shearing action is obtained. Plugs 122 are inserted in the bottom of the member 137 to close the access openings for screws 120 and also to prevent the screws 120 from loosening.

While only one embodiment of the invention has been illustrated and described, it is apparent that alterations, modifications and changes may be made without departing from the true scope and spirit thereof.

What is claimed is:

1. Apparatus for packaging articles between sheets each having a cohesive coating on one side thereof comprising a pair of spaced frame portions, a first pair of rollers carried by one frame portion and providing a nip therebetween, a second pair of rollers carried by the other frame portion and providing a nip therebetween, means for driving each of the rollers of said pairs in synchronism, said pairs of rollers engaging the edges of said sheets of materials and feeding them between said nips to seal the side edges of the sheets one to the other, sets of rollers engaging said pairs of rollers to hold said sheets in engagement with said pairs of rollers, sheet cutting and sealing means disposed beneath said pairs of rollers and operable to form an upper transverse seal between sheet portions, to form a lower transverse seal between said sheet portions and to sever said sheets between said transverse seals, whereby articles to be packages are inserted between the sheet portions carried by said pairs of rollers whereupon said rollers are operated to feed the sheets with the article disposed therebetween downwardly to a position wherein said article is disposed beneath said cutting and sealing means, said cutting and sealing means is then operated to seal said sheets to form a sealed container with the article disposed therein, sever the container and seal the sheets above the point of severence to form the bottom of the successive container.

2. Apparatus according to claim 1 including means for cyclically operating said cutting and sealing means and means for varying the rate at which said sheets are fed between said rollers for controlling the length of the container to be formed.

3. Apparatus according to claim 1 wherein each of said pairs of rollers includes a drive gear therefor with the gears of each pair of rollers being in meshing engagement, gearing means coupling the last said gears for operation in synchronism, cyclically operated driving means periodically operating said cutting and sealing means and variable speed means coupling said driving means with said gearing means to vary the speed of said pairs of rollers between successive cutting and sealing operations.

4. Apparatus according to claim 3 wherein said driving means comprises a first drive shaft extending between said frame portions and carrying gears meshing with at least one gear on each of said pairs of rollers, a pinion including a clutch on said shaft to rotate said shaft when said pinion is rotated in one direction, a rack engaging said pinion, a second drive shaft, an arm carried by said second drive shaft, means adjustably pivoting an end of said rack to said arm whereby rotation of said second drive shaft will effect movement of said rack in one direction and rotation of said pinion to operate the first drive shaft while movement of the rack in the other direction will not impart rotation to said first drive shaft, and means carried by said second drive shaft for actuating said cutting and sealing means once during each rotation thereof.

5. Apparatus according to claim 4 wherein said cutting and sealing means comprises a pair of heads each carrying a cutting blade and sealing surfaces above and below said blade, each of said heads being carried by a pair of arms pivoted to the frame portions, gears coupling the arms of each head for simultaneous operation thereof and a cam carried by said second drive shaft for engaging one of said arms to move the cutting heads one toward the other to effect the cutting and sealing operations and then release the heads for movement outwardly one relative to the other.

6. Apparatus according to claim 5 wherein said pairs of rollers and associated gears are carried by plates, transverse threaded rods rotatably carried by said frame portions and extending through openings in said plates, at least one of said plates threadably engaging said rods and means for simultaneously rotating said rods to modify the spacing between said pairs of rollers to accommodate sheets of varying widths.

7. Apparatus according to claim 6 wherein each of said pairs of rollers includes feed rollers on each side thereof for guiding the edges of said sheets to said pairs of rollers and a knurled roller associated with each roller of said pairs of rollers and bearing against the last said roller and adjoining feed roller to securely hold the edges of said sheets in engagement with said pairs of rollers.

8. Apparatus according to claim 7 wherein said knurled rollers are carried by plates pivoted to transverse shafts secured to said frame portions for movement toward and away from said pairs of rollers.

9. Apparatus for sealing articles between sheets of material each having a cohesive coating on one side thereof comprising a pair of side frame means, means including sets of rollers individually pivoted to said side frames and positioned on each side of said sheets for sealing the edges thereof, cutting and sealing means disposed immediately beneath said rollers for transversely sealing said sheets along upper and lower spaced parallel lines and severing said sheets between the last lines, means for cyclically operating said apparatus upon insertion of an article between the sheets whereby said cutting and sealing means is operated at the end of each cycle to complete one enclosure, form the bottom of the next successive enclosure preparitory to receiving an article and severing the completed enclosure and means for operating said sets of rollers during each cycle to feed said sheets at a predetermined rate to provide the desired length of sheets to enclose the article and provide space for said lower transverse seal.

10. The method of sealing articles between sheets of material each having a cohesive coating on one side thereof comprising the steps of feeding said sheets between spaced sets of individually pivoted rollers adjusted to engage the edges of said sheets to form edge seals, forming spaced parallel upper and lower transverse seals on that portion of said sheets immediately below said rollers and simultaneously severing the sheets between the last said seals whereby an article inserted between said sheets is completely enclosed by said edge seals and the lower of said transverse seals and severed from the sheets to form a discrete package while the upper of said transverse seals forms the bottom of the next successive package still in engagement with said rollers.

11. The method according to claim 10 wherein said severence is effected by moving a pair of cutting blades one toward the other.

12. The method according to claim 11 including the step of clamping said sheets in engagement with said sets of rollers.

* * * * *